United States Patent [19]

Swartz

[11] 4,370,357

[45] Jan. 25, 1983

[54] PROCESS OF CONTINUOUS METAL COATING

[75] Inventor: LeRoy O. Swartz, Bensalem, Pa.

[73] Assignee: Cleveland Gear Company, Bensalem, Pa.

[21] Appl. No.: 242,621

[22] Filed: Mar. 11, 1981

[51] Int. Cl.[3] ..... B05D 3/02

[52] U.S. Cl. ..... 427/46; 34/1; 34/36; 34/77; 34/78; 118/58; 118/61; 118/65; 118/620; 219/10.41

[58] Field of Search ..... 118/620, 58, 61, 64, 118/65; 34/1, 77, 78, 36, 73, 331, 352; 427/46, 444, 428, 209, 211; 219/10.41

[56] References Cited

U.S. PATENT DOCUMENTS

| | | | |
|---|---|---|---|
| 3,561,131 | 2/1971 | Swartz | 34/73 |
| 3,576,664 | 4/1971 | Swartz | 34/1 X |
| 4,118,873 | 10/1978 | Rothchild | 34/36 |
| 4,150,494 | 4/1979 | Rothchild | 34/77 X |
| 4,185,397 | 1/1980 | Hutzenlaub | 34/36 X |
| 4,223,450 | 9/1980 | Rothchild | 34/16 |

*Primary Examiner*—Thurman K. Page

*Attorney, Agent, or Firm*—Eugene Chovanes; Edward Lovett Jackson

[57] ABSTRACT

An improved process and/or system for coating of a metal strip includes means for continuous travel of the strip and a chamber for substantially completely enclosing the strip beyond an area for application of a mixture of coating and solvent. In that chamber is at least one induction coil for induction heating the strip to drive off the solvent, means for introducing substantially pure nitrogen near opposite ends of the travel of the strip therein and in between the places of introduction of the substantially pure nitrogen means for removing the resultant mixture of nitrogen and solvent which mixture is then at least largely separated into its components and reclaimed nitrogen brought back into the chamber at locations between the location of removal of the mixture and the respective locations of introduction of substantially pure nitrogen. The temperature of the interior atmosphere of the chamber is automatically maintained at a predetermined temperature preferably within the range between about 300° F. and 600° F. and at all events about 300° F. or greater.

3 Claims, 10 Drawing Figures

PROCESS OF CONTINUOUS METAL COATING

SUMMARY OF THE INVENTION

The present invention relates to a process and/or system of continuous metal coating.

It is a new process and/or system which is an improvement over my own earlier process and apparatus. My own earlier invention is in substance described and claimed in LeRoy O. Swartz U.S. Pat. Nos. 3,561,131 and 3,576,664, which are both incorporated by reference herein, and the new process and/or system includes in its total and complete detailed exemplary description various features of the old. It also in such description includes a feature or features of an overall Rothchild development or developments found in Rothchild U.S. Pat. Nos. 4,223,450; 4,150,494 and/or 4,118,873, especially 4,223,450 and 4,150,494, which three Rothchild patents are likewise herein incorporated by reference.

BRIEF DESCRIPTION OF THE INVENTION

A purpose of the present invention is to decidedly improve the already worthwhile economy of my earlier invention in producing coated metal strip, while at the same time maintaining fully its effectiveness as far as the quality of the coated metal strip which is produced by the process and/or system is concerned.

A more specific purpose of the present invention is to recover an especially great proportion of the expensive solvent which forms a large part of the total liquid material which is normally used in the coating process of my earlier invention, and at the same time very much to minimize or practically totally eliminate any slightest escape of possible pollutant into the atmosphere, while also maintaining the quality of the product in a condition for immediate use as soon as sufficiently cool, without requiring any subsequent processing of that product beyond anything involved in the original invention.

A further purpose of the invention is to ultimately recover almost all of that solvent, or, as an optional alternative, to make the process of coating completely self-sufficient from an overall energy standpoint, and indeed productive of at least some additional energy beyond that, to otherwise utilize or to market, without in any way reducing the quality of the coated metal product.

Further purposes of the present invention will be apparent from the rest of the application herein.

SHORT DESCRIPTION OF DRAWINGS

FIG. 1 is a largely schematic illustrative view, with labeling, of a preferred exemplary embodiment of a system which is carrying out the process of the invention, which view includes a vertical section of the enclosed area in which the metal strip is being heated by induction to drive off the solvent, and elevational views of certain tanks, one of which views is broken away to show liquid in the interior.

FIG. 1*a* is a top plan view of the above enclosed area, including a horizontal section along the line 1*a*—1*a* in FIG. 1 of the metal strip, with certain pipes broken away.

Figure 5:
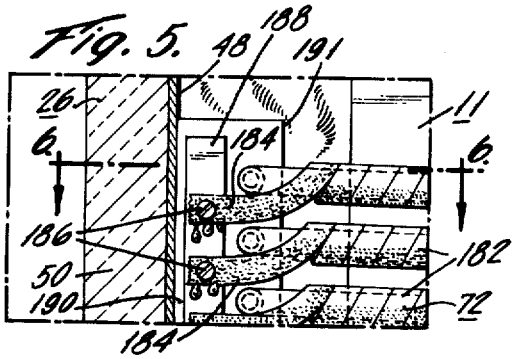
FIG. 5 is a still further enlarged vertical section on a rectangular plane area pointed to in FIG. 2 by the arrow extending from the words "FIG. 5."
Figure 6:
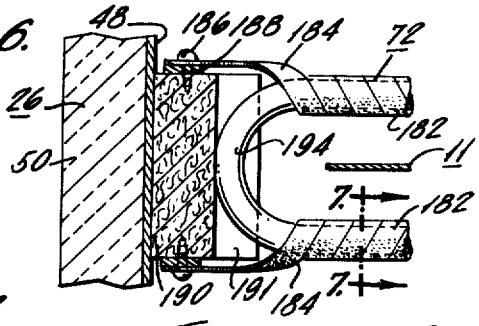
FIG. 6 is a horizontal section looking downward along the line 6—6 in FIG. 5.
Figure 7:
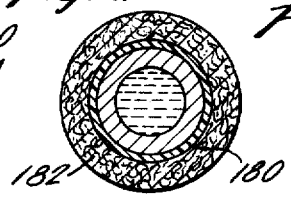
FIG. 7 is a still further enlarged cross section of one of the cooling pipes and surrounding material taken along the line 7—7 in FIG. 6, looking to the right toward the central axial plane of the enclosed area.
Figure 8:
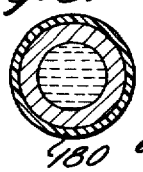
Figure 9:
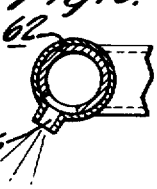

FIG. 8 is a view similar to FIG. 7 but of a somewhat variant embodiment from that of FIGS. 1, 2 and 4 through 7. FIGS. 1*a*, 3 and 9 apply to both the embodiment of FIGS. 1, 2 and 4 through 7 and that of FIG. 8

Figure 2:
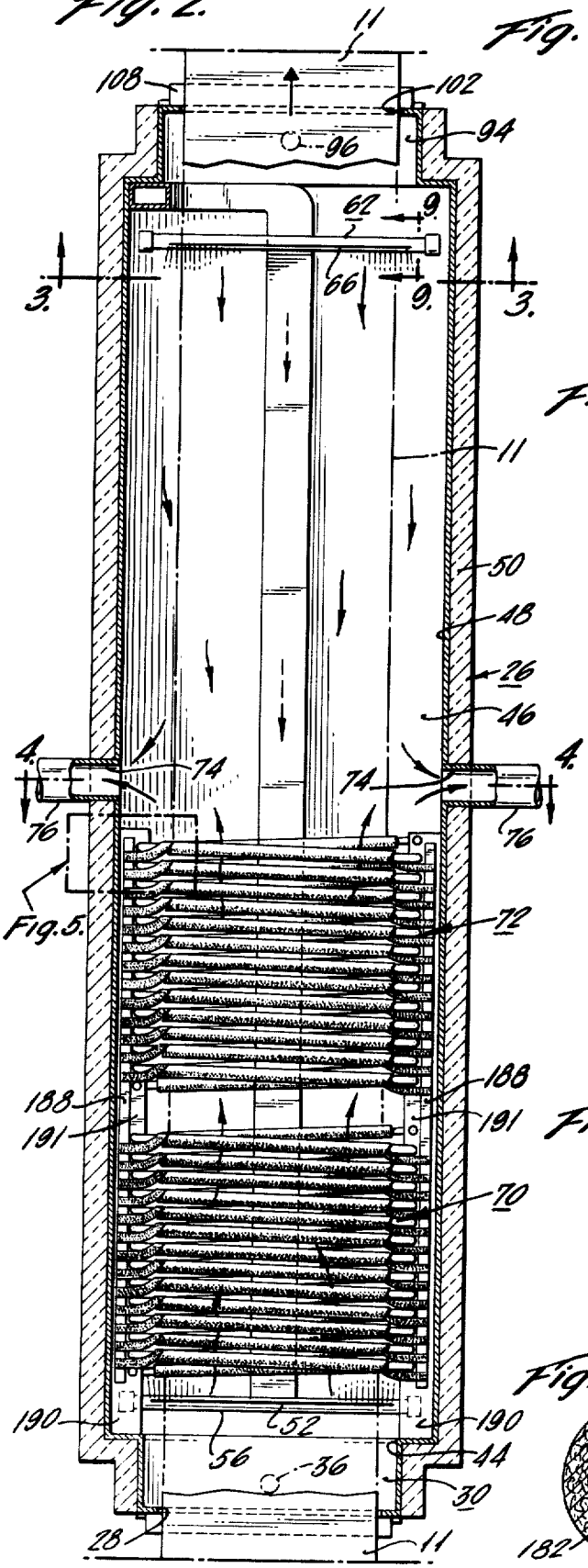
FIG. 2 is an enlarged vertical section of the above enclosed area along the line 2—2 in FIG. 1, also with pipes broken away.
Figure 3:
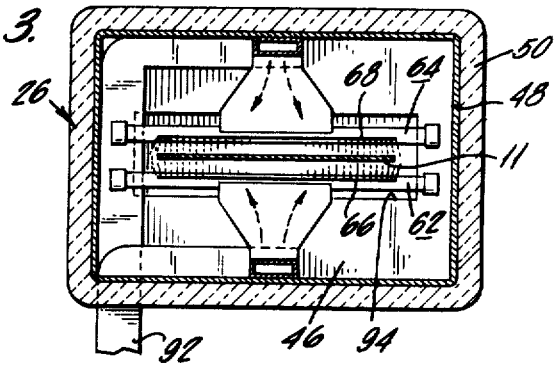
FIG. 3 is a horizontal section looking upward along the line 3—3 in FIG. 2.
Figure 4:
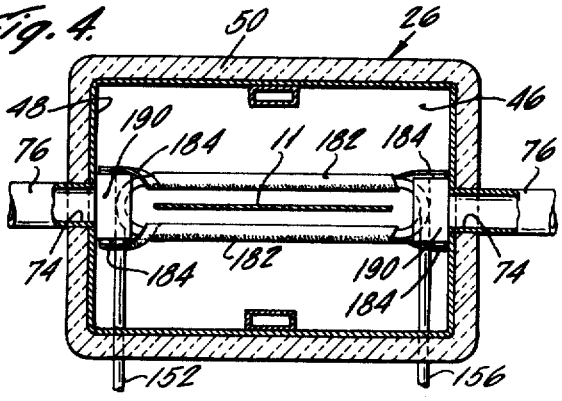
FIG. 4 is a horizontal section looking downward along the line 4—4 in FIG. 2.

FIG. 9 is a vertical section of a portion of the above enclosed area which is common to both above embodiments and is taken along the line 9—9 in FIG. 2 looking to the left toward the central axial plane of the area, with an enlargement intermediate between that in FIGS. 5 and 6 and that in FIGS. 7 and 8.

DESCRIPTION OF SPECIFIC EMBODIMENTS

Describing in illustration and not in limitation, and referring to the drawings, a specific embodiment of the present invention which is preferred but not necessarily the most preferred is as follows, this being the embodiment of FIGS. 1 and 1*a* (which applies to both embodiments that will be described), 2, 3 (which likewise applies to both embodiments), 4 through 7, and 9 (which likewise applies to both embodiments).

Figures 1, 1A:
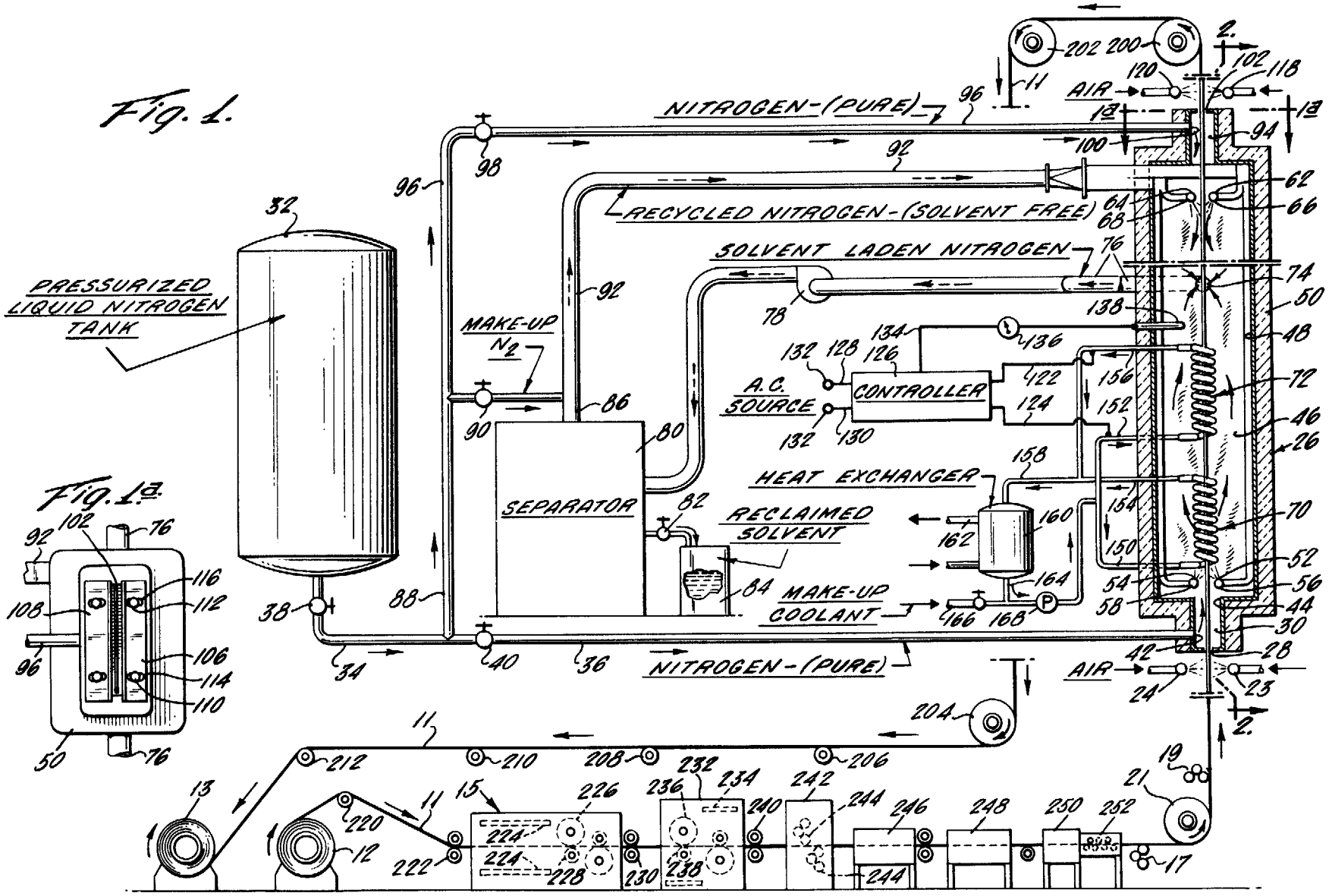

The setup in its entirety is shown schematically in FIG. 1, with suitable legend forming part of the figure, and the description here will start with the particular features that are the most essential from the earlier form on which this is an improvement and also the changed features, and will then go to certain features which would be usual along the lines of the previous unimproved setup, but which can readily be varied in various ways to suit particular situations without at all affecting the essential and the improved parts.

As will be evident from the drawings, the coating is done on a suitable strip of metal which will be designated as 11, in which the strip will pass from an original coil 12 over numerous rollers in a considerable travel to final coil 13 under an impetus provided as desired by various of the rollers which will keep it traveling continuously when the coating is being done, with the original uncoiler and final coiler which can be of standard form, of course playing whatever specific part may be desired in this whole process.

In the course of this travel, the strip will normally go through various preparatory steps in preparatory phase 15, which can vary quite considerably depending upon what seems to be appropriate to the particular situation. The particular form of the preparation forms no part of the present invention except that some suitable preparation will normally be desirable, and so it will not be described at the outset, but eventually description will be made as part of this present description of a perfectly suitable type of set of preparatory steps which can be used if desired.

After the strip has gone through these preparatory steps, the particular coating which is desired to be used will be applied to all or some part of the strip on one or both sides as desired in some suitable way in which the particular showing is of a group of rollers 17 for one side and a group of rollers 19 for the other. In the form shown, there is a roller 21 in between these groups, which changes the direction of travel of the strip from the horizontal to an upward vertical direction in this particular case and can of course aid the travel of the strip if desired. After the strip in this particular embodiment is traveling in the upward direction after the application of all desired coating, it passes between two air outlets designated respectively 23 and 24 which blow air upon the two sides of the strip respectively and then passes into enclosed chamber 26 through opening 28 in the bottom of the chamber in this case which is preferably, for any particular strip, an opening which is substantially the minimum size of opening through which the particular strip will readily pass. Once inside of the opening, the strip will be in vestibule 30 into which substantially pure nitrogen will be coming. This substantially pure nitrogen will be ultimately coming from pressurized liquid nitrogen tank 32 and traveling through pipes 34 and 36, each of which includes valves 38 and 40 respectively, and then will travel through its own opening 42 into the vestibule, this opening in this particular example shown being directed toward one side of the strip and with the nitrogen under the influence of the traveling strip having a tendency to go upward within the vestibule, through upper end 44 of the vestibule, which is not constricted into a narrow opening the way the lower end of the vestibule is around opening 28 for the strip. At this upper end the strip goes to the main interior 46 of the enclosure 26, which enclosure is mainly made up of an interior wall 48, which is preferably of some non-magnetic material which is substantially impervious to gas, this wall being for example preferably made of some material such as aluminum or a non-magnetic form of stainless steel, and around the metal wall is preferably a heat insulating exterior wall 50. Once inside of the main part of the enclosure, the metal strip passes between two slit openings 52 and 54, the slit in each case being along pipes 56 and 58 running laterally horizontally along the width of each side of the strip respectively, and so placed and directed as to bring what is in the interior of the pipe out through the opening against the respective sides of the strip in an obliquely upward direction, away from the vestibule and obliquely in the direction of the upward travel of the slit. Just before the upwardly traveling strip reaches the top of the main part of the chamber, there are similar pipes 62 and 64 respectively whose slits 66 and 68 respectively are so placed and directed as to bring what is in its pipes obliquely downward against the two sides of the strip and thus more or less counter to the travel of the strip.

After traveling between the lower pipes 56 and 58 as already mentioned, the strip in its upward traveling in the main part of the chamber in this particular embodiment goes through two helical coils 70 and 72 respectively through which high frequency current, such as for example at a frequency of something like 3,000 to 10,000 cycles per second, is passing, thus inducing high frequency currents in the strip within the coil in each case, and then there are openings 74 which are located approximately in the middle of the enclosure in the wall of the enclosure near opposite edges of the strip. From these openings solvent-laden nitrogen resulting from the evaporation of the solvent from the originally liquid coating because of the heat imparted into the strip within the coils by the induced current, is withdrawn through pipes 76 which are connected to the respective openings. In order to withdraw this solvent-laden nitrogen, pump 78 is in the pipe and withdraws the solvent-laden nitrogen into separator 80, where an already known multi-stage condensation process divides it into reclaimed solvent which passes through valve 82 into tank 84, and nitrogen for recycling which is more or less solvent-free passes out of the separator through pipe 86. Into pipe 86 substantially pure nitrogen from tank 32 also is brought through pipe 88 and valve 90 as a source of makeup nitrogen to replace any nitrogen which may have been lost previously and enable the nitrogen from the separator mixed with the makeup, substantially pure, nitrogen to travel back through pipe 92 to be recycled by being brought into openings 66 and 68 and 52 and 54 into the chamber.

At the top end of the enclosure is vestibule 94 to which the main part of the chamber has access substantially without constriction, and into which pipe 96 brings substantially pure nitrogen through valve 98 and opening 100 in the vestibule 94, this being also from the pressurized liquid nitrogen tank. The strip after passing through the vestibule 94 where the substantially pure nitrogen comes onto it through that opening, then passes out of the enclosure through opening 102 which is preferably so set that it is substantially as small as is compatible with ready exit of the particular strip.

FIG. 1*a* shows in the form of a view at the top a particular setup which permits the opening to be adjustable, involving plates 106 and 108 on either side of the opening held in appropriate position by bolts or set screws 110 and 112 in the one plate and a corresponding pair in the other, which are in slits 114 and 116 respectively in the one plate and a corresponding pair of slits in the other, thus enabling the plates to be moved and set in positions appropriate to the desired size of the opening out of the top vestibule into the surrounding air. A similar setup can perform a similar function at bottom opening 28 from the surrounding air into the bottom vestibule. Outside of the top vestibule are pipes 118 and 120 which permit air to be blown against each side of the strip outside of the opening in the nearby vestibule.

The electric coils 70 and 72 preferably are in the form of hollow pipes of some suitable material such as copper, permitting use of a suitable cooling fluid in the interior of the electric pipes. The electric pipes are electrically connected through wires 122 and 124 through a standard type of controller 126 and wires 128 and 130 to a suitable alternating current source 132 for the desired high frequency current.

Also connected to the controller through wire 134, in which is suitable recorder 136 for the temperature which is sensed is temperature sensing device 138 inside the chamber in a position which will essentially sense the temperature of the nitrogen and solvent atmosphere inside that chamber at a point between the top end of the upper coil and the outlet for the solvent-laden nitrogen in the chamber. This allows the temperature of the atmosphere in the chamber to be controlled in a well known manner. This control in this particular case is shown as utilizing the controller in a way in which variation in the electrical input into the coils affects the temperature of the coils and strip in a way which determines under a given setting of the system as a whole the temperature of the nitrogen and solvent mixture inside the enclosure as a result of the fact that greater electrical input into the coils, everything else being the same, has the effect of increasing the temperature of the coil and strip and thus the amount of heat input into the nitrogen (with solvent) atmosphere of the interior of the chamber in a well known way.

Thus automatic regulation can be secured of the nitrogen (with solvent) atmosphere inside the enclosure by appropriate settings of all other features and variation of the electrical input into the coils, the regulation in this manner thus spoken of being of course of the temperature.

This is important because it is highly essential for good results as far as the ultimate condition of the strip is concerned in this particular improved process, that the solvent-laden nitrogen atmosphere in the totally enclosed chamber be held above a critical temperature so that, after driving off of the solvent from the exterior of the strip by means of the induced current heating, the solvent from the solvent-laden nitrogen will not tend to redeposit on the strip as the strip travels toward the upper end of the chamber.

This critical temperature above which the solvent-laden nitrogen must be held is approximately 300° Fahrenheit. There is also an upper limit for the temperature of the atmosphere within the chamber which depends at least partly on the particular characteristics of the paint or other such material within the coating, but in general as a practical matter, the temperature of the nitrogen should be between about 300° Fahrenheit and 600° Fahrenheit as a matter of preference, and in general but not preferred, between around 300° Fahrenheit to around 800° Fahrenheit. These particular temperatures are temperatures for the nitrogen atmosphere (along with any solvent present at any given place), whereas for example when the atmosphere is around 300° Fahrenheit, the strip will very likely be around 450° Fahrenheit, for example.

The cooling setup for the coils involves pipes 150 and 152 going into the lower ends of coils 70 and 72 respectively to bring coolant into the coils, pipes 154 and 156 to bring coolant out of the upper end of the previously mentioned coils respectively, pipe 158 bringing the coolant from both of these most recently mentioned pipes to heat exchanger 160, pipe 162 from the top of the heat exchanger to utilize the heat as desired and then bring the carrier for the heat thus utilized back into the bottom of the heat exchanger, and pipe 164 for coolant to pass out of the bottom of the heat exchanger and join with makeup coolant 166 in a circulation induced by pump 168 to bring the coolant after the heat exchange into the pipes which bring it into the bottom of the respective coils.

In this first embodiment, the coolant will be water and there will be a special setup to make it practical to use water for this purpose in this particular situation. Around the pipe which contains the water will be electrical insulation 180 which can for example be nylon or teflon. Around that electrical insulation will be a layer of moisture absorbent material such as asbestos which is designated by the numeral 182. This will be in form of a spiral wrapping in which the end toward the end of the essentially rounded rectangular coil members will go off at 184 in the case of each of the two spiral wrappings at any one level of coil to an end near the interior wall of the enclosure. At this point, the end of the wrapping will be held by a screw such as 186 to the outside of flat vertical non-magnetic bar 188 which is of metal and is held by the screw to the outside edge of vertical plastic block 190 which together with inner vertical plastic block 191 supports the ends 194 of the rounded rectangular coil members. The effect of the setup is for moisture from the interior of the chamber to be absorbed by the wicking effect of the wrapping 182 and thus brought to the vertical bar where the heat of the vertical metal bar makes it evaporate or as might be stated, "sizzle off." As a practical matter, this furnishes a satisfactory setup in which to use water as a coolant.

The other embodiment, shown especially in FIG. 8 contemplates the use of a coolant with a higher boiling point than water, such as a relatively high boiling point hydrocarbon. An example of such a relatively high boiling point hydrocarbon is normal heptadecane, the 17 carbon member of the alkane series, which could be used if already relatively low but suitable temperatures in the above temperature ranges were desired to be used, or some much higher member of the series if high temperatures were desired to be used.

In the embodiment using these high boiling point materials as coolants, shown in FIG. 8., the spiral wrapping with the wicking material can be dispensed with and also the vertical metal bars which this wicking material brings moisture to, but utilizing the end blocks for support and the electrical insulating layer around the metal pipe for the coolant.

After the strip has gone past the final air blasts 118 and 120, it will preferably go in both embodiments over cooling rollers 200 and 202 and 204 and traveling rollers 206, 208, 210, and 212 to be wound up again at coiler 13. A suitable setup for the preparatory steps of the strips traveling will involve after it is unwound at 12, travel roller 220, pinch rolls 222, sprays 242 of alkali solution which are projected against both sides of the strip, scrubbing rollers 226 for scrubbing and cleaning the strip, backup rollers 228 to support it during this part of the operation, pinch rollers 230 to guide it into apparatus 232 where are sprays 234 and abrasive wheels 236, with support from backup rollers 238. Pinch rollers 240 guide it into apparatus 242 in which are rollers 244 which apply a chemical coating to condition the strip for the paint to be put upon it. Rinsing apparatus 246 then rinses the strip, drying means 248 then dries it and auxiliary drying and leveling means 250 and 252 respectively are also applied, after which its preparation for application of coating at 17 and/or 19 is complete.

As will be understood the above reference to cooling rollers is a reference to a setup like that in my earlier invention in this respect, in which these are internally water cooled rollers with cold water being supplied from a suitable source of a suitable specific line and manifold water supply line and taken away through outlets leading to a sump or other place where it can be gotten rid of.

In view of my invention and disclosure, variations and modifications to meet individual whim or particular need will doubtless become evident to others skilled in the art, to obtain all or part of the benefits of my invention without copying the apparatus and process shown, and I therefore claim all such insofar as they fall within the reasonable scope of my claims.

While it will be noted that the specific exemplary forms shown show application of the mixture of coating material and solvent at respectively different places on the different sides of the strip, it is if anything preferred that that mixture be applied to both sides at the same location, beyond the roller where the strip starts its vertical travel.

It will of course be understood that the atmosphere inside the chamber should be maintained at a pressure sufficient to prevent any substantial invasion of the chamber by air from outside.

Needless to say, the metal of metal strip should be such as to lend itself to an induction heating process.

Having thus described my invention, what I claim as new and desire to secure by Letters Patent is:

1. A method of recovering solvents evaporated during drying of solvent-borne coatings on continuously coated metal strip comprising:

(1) coating the strip;

(2) passing the strip continuously through a chamber having a nitrogen atmosphere;

(3) heating the strip above 450° Fahrenheit by electromagnetic induction means to drive off the solvent from the coating to create a solvent-laden nitrogen atmosphere;

(4) keeping the solvent-laden nitrogen atmosphere above 300° Fahrenheit by controlling the temperature of the strip;

(5) removing the solvent-laden nitrogen atmosphere from the chamber; and (6) separating the solvent from the nitrogen.

2. The process of claim 1 wherein the solvent-free nitrogen is returned to the chamber.

3. The process of claim 1 wherein the solvent-laden nitrogen atmosphere within the chamber is maintained between 300° Fahrenheit and 600° Fahrenheit.

* * * * *